US008892340B2

(12) United States Patent
Ishikawa et al.

(10) Patent No.: US 8,892,340 B2
(45) Date of Patent: Nov. 18, 2014

(54) ENGINE CONTROLLER AND ENGINE CONTROL METHOD

(75) Inventors: Osamu Ishikawa, Tokyo (JP); Takeru Okabe, Tokyo (JP); Tomohisa Shoda, Tokyo (JP); Hiroaki Kitano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 390 days.

(21) Appl. No.: 13/468,500

(22) Filed: May 10, 2012

(65) Prior Publication Data

US 2013/0110382 A1 May 2, 2013

(30) Foreign Application Priority Data

Nov. 2, 2011 (JP) ..... 2011-241106

(51) Int. Cl.
*F02D 41/06* (2006.01)
*F02D 41/22* (2006.01)
*F02N 11/08* (2006.01)

(52) U.S. Cl.
CPC ..... *F02N 11/0814* (2013.01); *F02D 41/22* (2013.01)
USPC ..... 701/113; 123/179.3

(58) Field of Classification Search
CPC ... F02N 11/08; F02N 11/087; F02N 11/0825; F02N 11/0814; F02D 41/06; F02D 41/221; F02D 41/22
USPC ..... 701/112, 113, 114; 123/179.3, 179.4, 123/179.5
See application file for complete search history.

(56) References Cited

U.S. PATENT DOCUMENTS

| | | | | |
|---|---|---|---|---|
| 2005/0109302 | A1* | 5/2005 | Tetsuno et al. | 123/179.5 |
| 2005/0132994 | A1* | 6/2005 | Itou et al. | 123/179.3 |
| 2005/0155418 | A1* | 7/2005 | Hoshi | 73/118.1 |
| 2006/0196460 | A1* | 9/2006 | Ohtsu et al. | 123/179.3 |
| 2007/0093948 | A1* | 4/2007 | Sago | 701/29 |

FOREIGN PATENT DOCUMENTS

JP 4506398 B2 7/2010

* cited by examiner

*Primary Examiner* — Mahmoud Gimie
(74) *Attorney, Agent, or Firm* — Sughrue Mion, PLLC; Richard C. Turner

(57) ABSTRACT

The engine controller includes: an engine-rpm increase amount computing section for computing an amount of increase in an engine rpm, generated by first ignition of an engine after a restart condition is satisfied; a start failure determination crank-angle change amount determination value setting section for setting a restart failure determination threshold value based on the amount of increase in the engine rpm; and a restart failure determination section for determining a restart failure when a crank-angle change amount from a first ignition timing of the engine after the satisfaction of the restart condition becomes larger than the restart failure determination threshold value although a complete combustion of the engine is not determined, interrupting a restart operation of the engine, and restarting the restart operation of the engine after elapse of a predetermined period of time.

5 Claims, 14 Drawing Sheets

ENGINE CONTROLLER AND ENGINE CONTROL METHOD

BACKGROUND OF THE INVENTION

1. Field of the Invention

The present invention relates to an engine controller and an engine control method including an engine automatic stop/restart device for automatically stopping an engine when a predetermined engine automatic-stop condition is satisfied and for restarting the engine when a restart condition is subsequently satisfied.

2. Description of the Related Art

Conventionally, an engine automatic stop/restart system has been developed for the purposes of improvement of fuel efficiency of an automobile, reduction of an environmental load, and the like. In the engine automatic stop/restart system, when a predetermined condition (for example, a brake-ON operation performed when a vehicle speed is equal to or lower than a predetermined speed) for stopping an engine by an operation performed by a driver, is satisfied, a fuel is automatically cut off to automatically stop the engine. Then, when a predetermined condition (for example, a brake-release operation, an accelerator depressing operation, or the like) for restarting the engine by an operation performed by the driver is satisfied, fuel injection is restarted to automatically restart the engine.

If a phenomenon which prevents a normal restart of the engine, such as an insufficient combustion, occurs when the engine is to be automatically restarted and hence the restart fails, it is necessary to determine that the restart has failed and perform the restart operation again so as to suppress a feeling of discomfort (feeling of delay in restart) given to the driver.

If the restart failure or the combustion abnormality at the restart cannot be quickly determined, the subsequent restart operation cannot be correspondingly quickly performed again. Therefore, it is important to set the timing of determination for the restart failure earlier while preventing an erroneous determination.

Thus, a conventional start control device for an engine determines that the restart fails when a complete-combustion state of the engine is not achieved within a prescribed number of cycles after the start of a restart operation (for example, see Japanese Patent No. 4506398).

However, the related art has the following problems.

FIG. 15 is an image diagram illustrating an operation and problems of the conventional start control device for the engine, which is described in Japanese Patent No. 4506398. In FIG. 15, a horizontal axis represents time, whereas a vertical axis represents an engine rpm. A solid line indicates an engine rotation behavior when the restart operation is normally performed, whereas a broken line indicates an engine rotation behavior in case of a restart failure.

As can be seen from FIG. 15, the number of cycles from a restart-operation start timing t1 to a timing t2 at which the engine complete-combustion state is achieved varies depending on the amount of increase in engine rpm in accordance with a combustion state at the restart. Therefore, when the amount of increase in engine rpm is small, the number of cycles required for achieving the engine complete-combustion state is disadvantageously increased.

In view of the increase in number of cycles, a margin is required to be provided to a restart failure determination threshold value (prescribed number of cycles) so as to prevent an erroneous determination of the restart failure. Thus, in the conventional start control device for the engine, which is described in Japanese Patent No. 4506398, the restart failure determination threshold value is set to a value corresponding to a timing t3 obtained by providing a margin to the timing t2 at which the engine complete-combustion state is achieved.

As indicated by the engine rotation behavior (see the broken line) in case of the restart failure, when the combustion state at the restart is poor, resulting in the restart failure at a timing t4 after the start of the restart operation, there is a problem in that the restart failure cannot be determined until the number of cycles becomes equal to the restart failure determination threshold value (specifically, the value corresponding to the timing t3) although the restart failure can be actually determined at an earlier timing. Moreover, there is another problem in that a time lag becomes large until the restart operation is restarted, disadvantageously giving a feeling of discomfort to the driver.

SUMMARY OF THE INVENTION

The present invention has been made to solve the problems described above, and therefore has an object to provide an engine controller and an engine control method, capable of determining a restart failure based on a restart failure determination threshold value set in accordance with a combustion state at the restart so as to quickly determine the restart failure while preventing an erroneous determination, and of performing a restart operation again without giving a feeling of discomfort (feeling of delay in restart) to a driver when the restart failure is determined.

According to the present invention, there is provided an engine controller including an engine automatic-stop/restart device for automatically stopping an engine when an engine automatic-stop condition is satisfied and restarting the engine when a restart condition is subsequently satisfied, including: a crank-angle sensor for detecting a crank angle of a crankshaft of the engine; an engine-rpm computing section for computing an engine rpm based on the crank angle; a crank-angle change amount computing section for computing a crank-angle change amount based on the crank angle; an engine complete-combustion determination section for determining a complete combustion of the engine when the engine rpm becomes larger than a preset predetermined rpm after the restart condition is satisfied; an engine-rpm increase amount computing section for computing an amount of increase in the engine rpm, generated by first ignition of the engine after the restart condition is satisfied; a start failure determination crank-angle change amount determination value setting section for setting a restart failure determination threshold value based on the amount of increase in the engine rpm; and a restart failure determination section for determining a restart failure when the crank-angle change amount from a first ignition timing of the engine after the satisfaction of the restart condition becomes larger than the restart failure determination threshold value although the complete combustion of the engine is not determined, interrupting a restart operation of the engine, and restarting the restart operation of the engine after elapse of a predetermined period of time.

According to the present invention, there is also provided an engine control method for automatically stopping an engine when an engine automatic-stop condition is satisfied and for restarting the engine when a restart condition is subsequently satisfied, including: a crank-angle detection step of detecting a crank angle of a crankshaft of the engine; an engine-rpm computation step of computing an engine rpm based on the crank angle; a crank-angle change amount computation step of computing a crank-angle change amount based on the crank angle; an engine complete-combustion determination step of determining a complete combustion of the engine when the engine rpm becomes higher than a preset predetermined rpm after the restart condition is satisfied; an engine-rpm increase amount computation step of computing an amount of increase in the engine rpm, generated by first ignition of the engine after the restart condition is satisfied; a start failure determination crank-angle change amount determination value setting step of setting a restart failure determination threshold value based on the amount of increase in the engine rpm; and a restart failure determination step of determining a restart failure when the crank-angle change amount from a first ignition timing of the engine after the restart condition is satisfied becomes larger than the restart failure determination threshold value although the complete combustion of the engine is not determined, interrupting a restart operation of the engine, and restarting the restart operation of the engine after elapse of a predetermined period of time.

According to the engine controller and the engine control method of the present invention, the engine-rpm increase amount computing section (step) computes the amount of increase in engine rpm, generated by the first ignition of the engine after the restart condition is satisfied. The start failure determination crank-angle change amount determination value setting section (step) sets the restart failure determination threshold value based on the computed amount of increase in engine rpm. The restart failure determination section (step) determines the restart has failed when the crank-angle change amount from the first ignition timing of the engine after the restart condition is satisfied becomes larger than the restart failure determination threshold value although a complete combustion of the engine is not determined. Therefore, the restart operation of the engine is interrupted. Then, after the elapse of a predetermined period of time, the restart operation of the engine is performed again.

Therefore, it is possible to obtain an engine controller and an engine control method, capable of determining a restart failure based on a restart failure determination threshold value set in accordance with a combustion state at the restart so as to quickly determine the restart failure while preventing an erroneous determination, and of performing a restart operation again without giving a feeling of discomfort (feeling of delay in restart) to a driver when the restart failure is determined.

DETAILED DESCRIPTION OF THE PREFERRED EMBODIMENT

Figure 1:
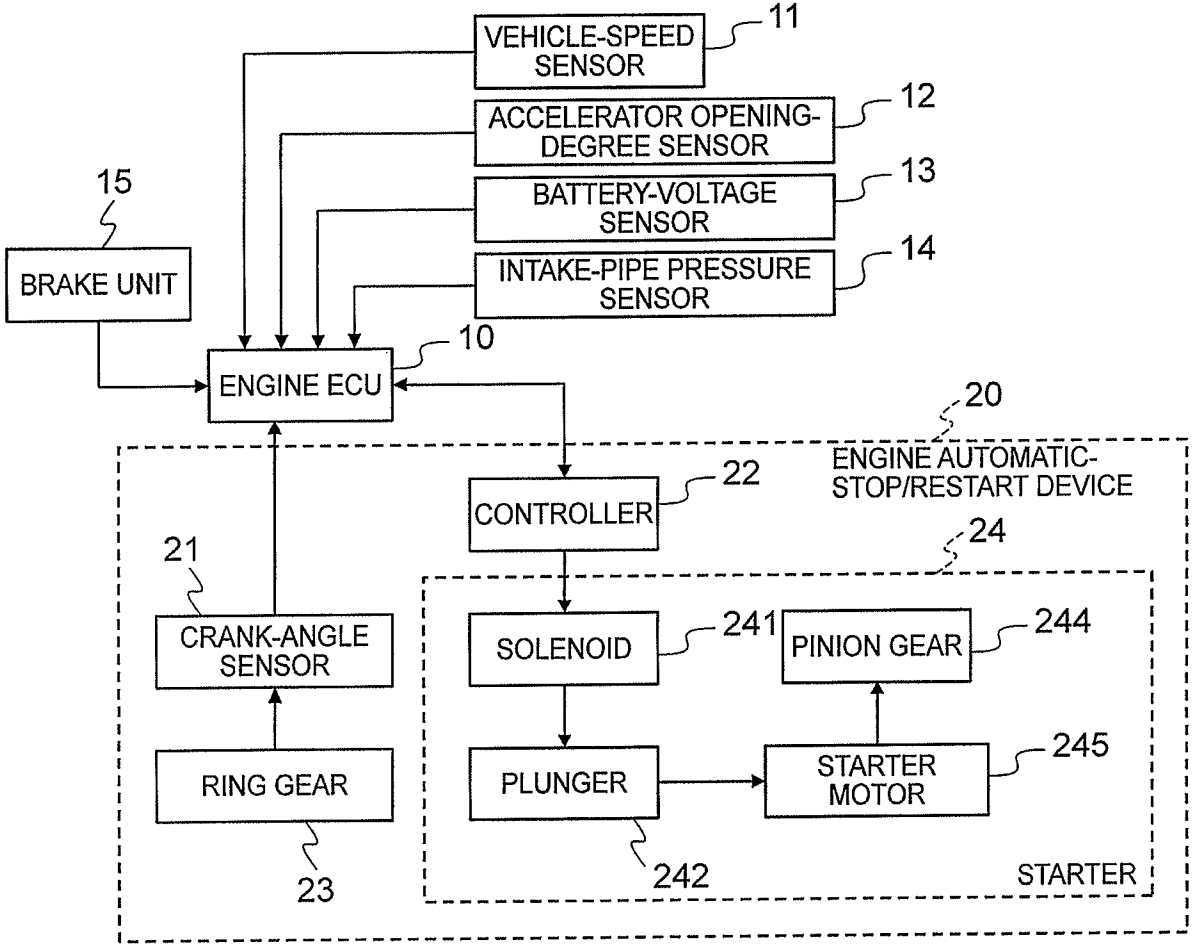
FIG. 1 is a block diagram illustrating a schematic configuration of an engine controller according to a first embodiment of the present invention.

Hereinafter, a preferred embodiment of an engine controller according to the present invention is described with reference to the accompanying drawings. In the drawings, the same or equivalent parts are denoted by the same reference numerals for description.

First Embodiment

Figure 2:
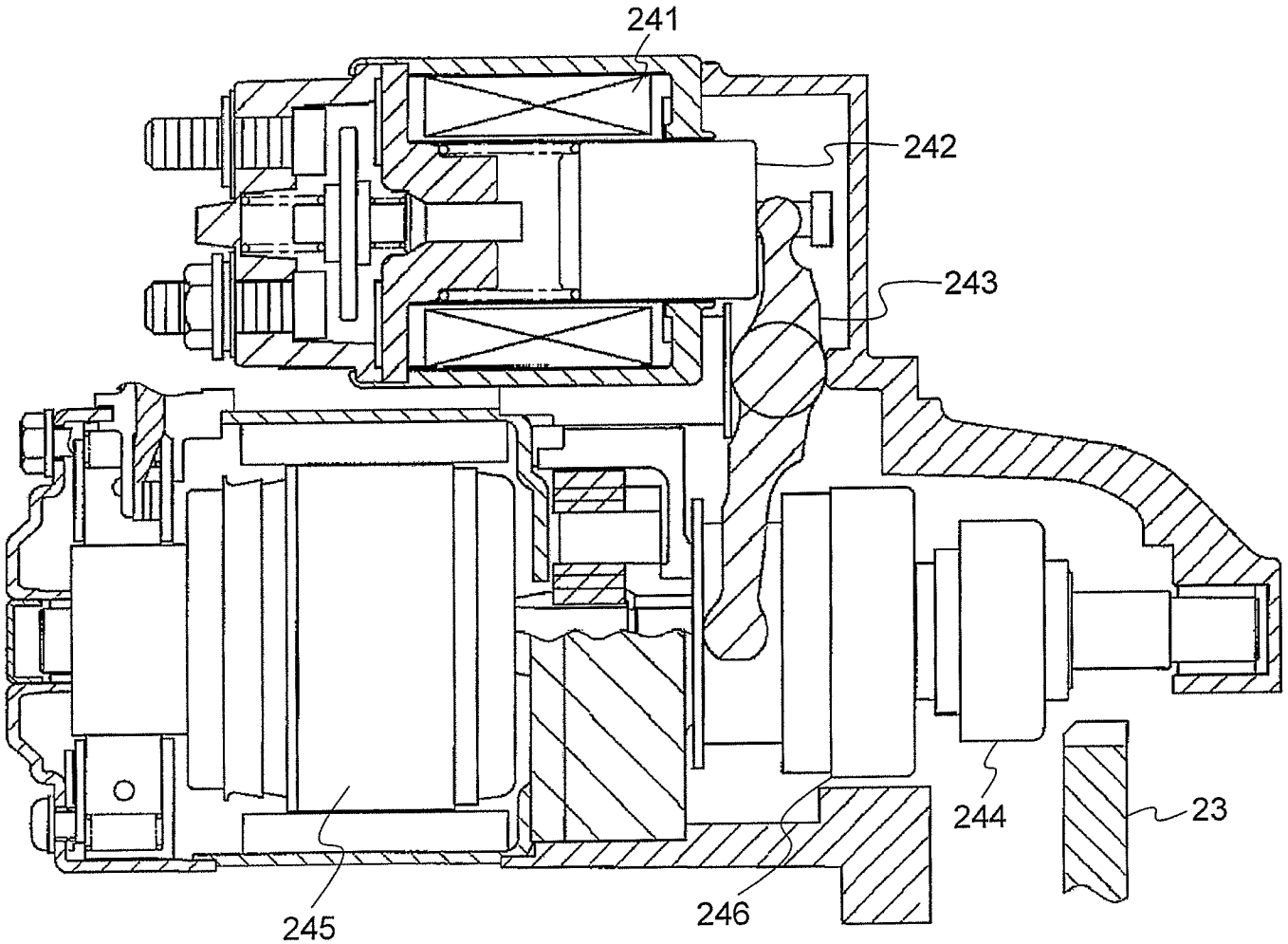
FIG. 2 is a partially cutaway front view of a starter included in an engine automatic stop/restart device of the engine controller according to the first embodiment of the present invention.

FIG. 1 is a block diagram illustrating a schematic configuration of an engine controller according to a first embodiment of the present invention. FIG. 2 is a partially cutaway front view of a starter included in an engine automatic stop/restart device of the engine controller according to the first embodiment of the present invention.

In FIG. 1, a vehicle-speed sensor 11, an accelerator opening-degree sensor 12, a battery-voltage sensor 13, an intake-pipe pressure sensor 14, a brake unit 15, and a crank-angle sensor 21 and a controller 22 included in an engine automatic stop/restart device 20 are connected to an engine ECU 10.

The vehicle-speed sensor 11 detects a speed of a vehicle to output a signal in accordance with the detected value (hereinafter, referred to as "vehicle-speed signal"). The accelerator opening-degree sensor 12 detects an accelerator opening degree to output a signal in accordance with the detected value (hereinafter, referred to as "accelerator opening-degree signal"). The battery-voltage sensor 13 detects a battery voltage to output a signal in accordance with the detected value (hereinafter, referred to as "battery-voltage signal").

The intake-pipe pressure sensor 14 detects an intake-pipe pressure of an engine to output a signal in accordance with the detected value (hereinafter, referred to as "intake-pipe pressure signal"). The brake unit 15 outputs an operating state of a brake as a brake signal. The crank-angle sensor 21 detects a crank angle for determining an injection timing and an ignition timing for a fuel to output a signal in accordance with the detected value (hereinafter, referred to as "crank-angle signal").

The engine ECU 10 determines an engine automatic stop or an engine restart based on the signals from the aforementioned sensors and the brake unit 15 to output a drive command to the controller 22 of the engine automatic stop/restart device 20 and control fuel injection to the engine and ignition.

Subsequently, with reference to FIG. 2 in addition to FIG. 1, a configuration and an operation of the engine automatic stop/restart device 20 are described. In FIGS. 1 and 2, the engine automatic stop/restart device 20 includes the crank-angle sensor 21, the controller 22, a ring gear 23, and a starter 24. The ring gear 23 is connected to a crankshaft (not shown) of the engine. The controller 22 controls driving of the starter 24, specifically, energization of a solenoid 241 in response to the driving command from the engine ECU 10.

By the energization of the solenoid 241, a plunger 242 is attracted to move a pinion gear 244 through an intermediation of a lever 243. As a result, the pinion gear 244 and the ring gear 23 are brought into meshing engagement with each other. Moreover, by the movement of the plunger 242, a contact is closed to allow the starter motor 245 to be energized so as to rotate the pinion gear 244. In a state in which the ring gear 23 and the pinion gear 244 are held in meshing engagement with each other, a driving force is transmitted to the engine. A one-way clutch 246 is connected to an output shaft of a starter motor 245. When a torque is input from the ring gear 23, the one-way clutch 246 slips.

Figure 3:
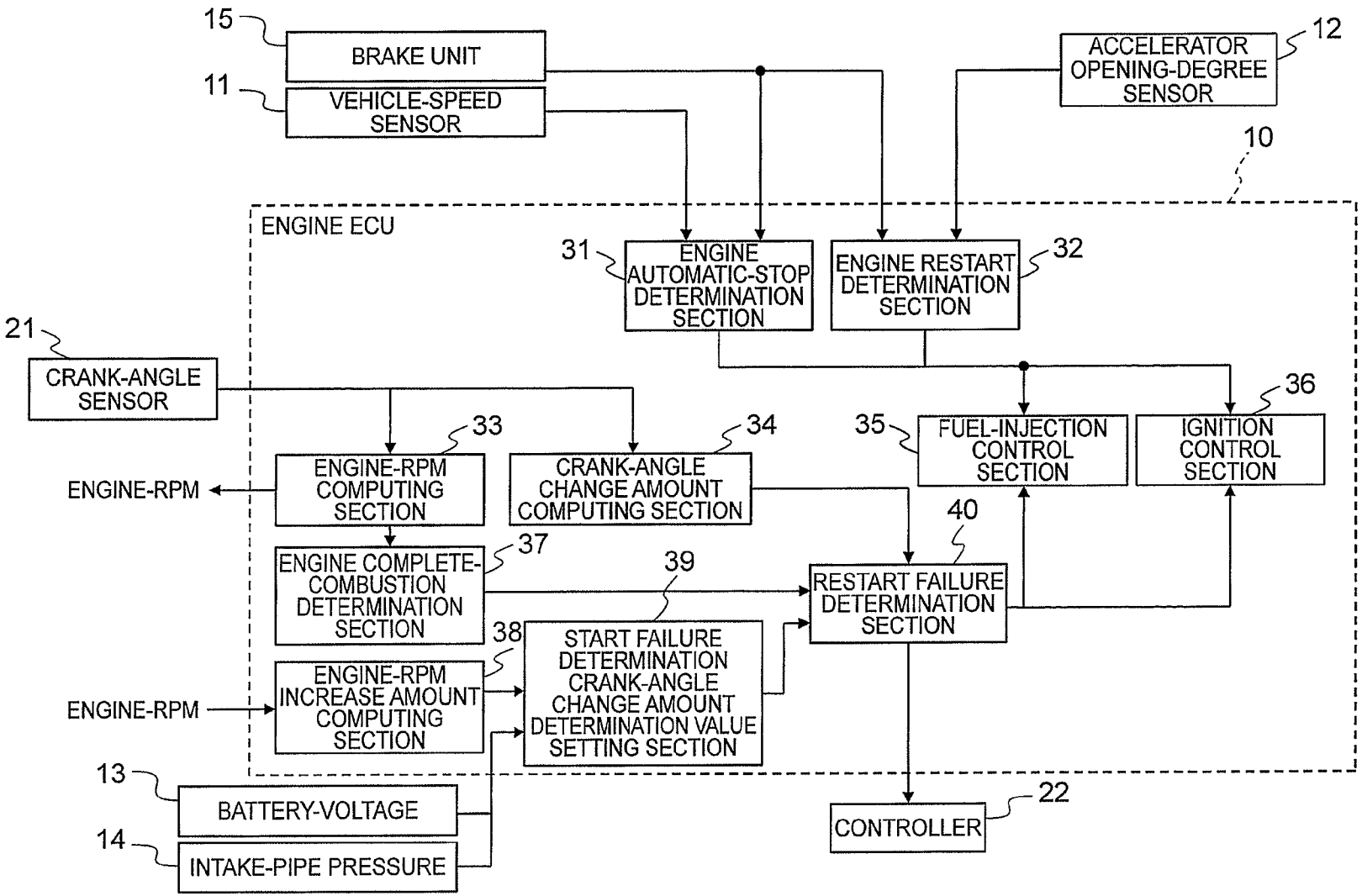
FIG. 3 is a block diagram illustrating a schematic configuration of an engine ECU included in the engine controller according to the first embodiment of the present invention.

FIG. 3 is a block diagram illustrating a schematic configuration of the engine ECU 10 included in the engine controller according to the first embodiment of the present invention. In FIG. 3, the engine ECU 10 includes an engine automatic stop determination section 31, an engine restart determination section 32, an engine-rpm computing section 33, a crank-angle change amount computing section 34, a fuel-injection control section 35, an ignition control section 36, an engine complete-combustion determination section 37, an engine-rpm increase amount computing section 38, a section 39 for setting a crank-angle change amount determination value for determining a start failure (hereinafter, referred to as "start failure determination crank-angle change amount determination value setting section"), and a restart failure determination section 40.

The engine automatic stop determination section 31 determines whether or not engine automatic-stop conditions (for example, a vehicle speed equal to or lower than 5 km/h and a depressing operation of the brake by a driver, and the like) are satisfied based on the brake signal from the brake unit 15 and the vehicle-speed signal from the vehicle-speed sensor 11.

The engine restart determination section 32 determines whether or not engine restart conditions (for example, such as a released state of the brake performed by the driver and a depressing operation of an accelerator pedal by the driver) based on the brake signal from the brake unit 15 and the accelerator opening-degree signal from the accelerator opening-degree sensor 12.

The engine-rpm computing section 33 computes an engine rpm based on the crank-angle signal from the crank-angle sensor 21 to output a signal in accordance with the computed value (hereinafter, referred to as "engine-rpm signal").

The crank-angle change amount computing section 34 computes a crank-angle change amount based on the crank-angle signal from the crank-angle sensor 21 to output a signal in accordance with the computed value (hereinafter, referred to as "crank-angle change amount signal").

The fuel-injection control section 35 controls the fuel injection based on the results of determination made by the engine automatic-stop determination section 31 and the engine restart determination section 32, and an instruction from the restart failure determination section 40.

The ignition control section 36 controls the ignition based on the results of determination made by the engine automatic-stop determination section 31 and the engine restart determination section 32, and an instruction from the restart failure determination section 40.

The engine complete-combustion determination section 37 determines a complete combustion of the engine when the engine rpm signal from the engine-rpm computing section 33 becomes higher than a preset predetermined rpm.

The engine-rpm increase amount computing section 38 computes the amount of increase in engine rpm by the first ignition of the engine to output a signal in accordance with the computed value (hereinafter, referred to as "engine-rpm increase amount signal").

The start failure determination crank-angle change amount determination value setting section 39 sets a start failure determination crank-angle change amount determination value (restart failure determination threshold value) based on the battery-voltage signal from the battery-voltage sensor 13 at the time when the restart is requested, the intake-pipe pressure signal from the intake-pipe pressure sensor 14, and the engine-rpm increase amount signal from the engine-rpm increase amount computing section 38.

The restart failure determination section 40 determines that the restart has failed when the crank-angle change amount from a timing of the first ignition by the ignition control section 36, which is performed because the engine restart conditions are satisfied after the engine automatic stop is performed, becomes larger than the start failure determination crank-angle change amount determination value although the complete combustion of the engine is not determined. Therefore, the restart failure determination section 40 instructs the interruption of the fuel injection and the ignition and instructs the controller 22 to interrupt the energization of the solenoid 241.

Moreover, the restart failure determination section 40 instructs the restart of the fuel injection and the ignition after the elapse of a preset predetermined time period and instructs the controller 22 to restart the energization of the solenoid 241.

Hereinafter, an operation of the engine controller according to the first embodiment of the present invention is described.

In general, the pinion gear 244 has a smaller number of teeth than that of the ring gear 23. In this first embodiment, an rpm obtained by the conversion into an rpm of the ring gear 23 in view of a ratio of the number of teeth of the pinion gear 244 and that of the ring gear 23 is used for an rpm of the pinion gear and the engine rpm for simplification of the description.

Figure 4:
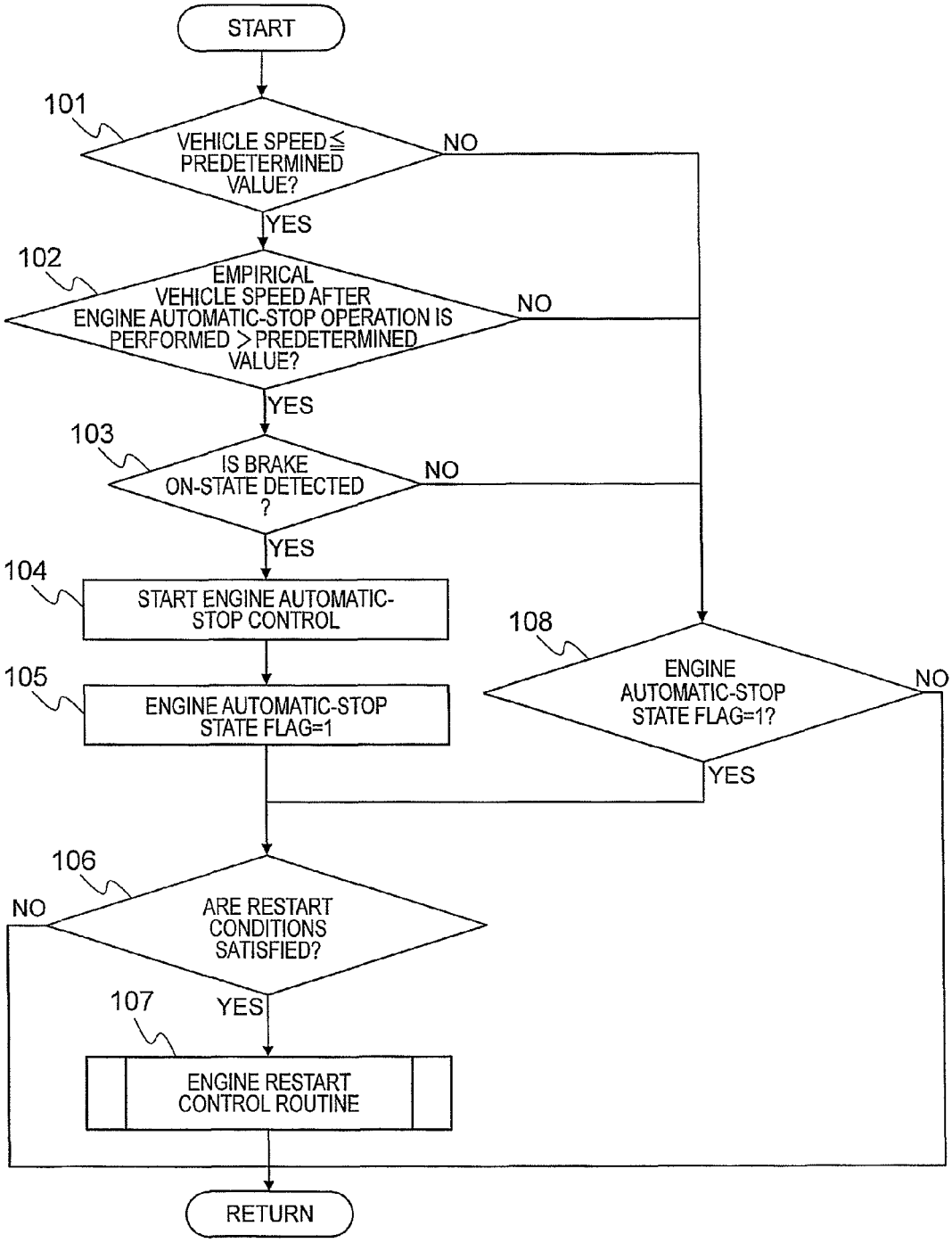
FIG. 4 is a flowchart illustrating a flow of a fuel cut-off control routine performed in the engine controller according to the first embodiment of the present invention.

FIG. 4 is a flowchart illustrating a flow of a fuel cut-off control routine performed in the engine controller according to the first embodiment of the present invention.

First, the engine automatic-stop determination section 31 determines whether or not the vehicle speed is equal to or lower than the predetermined value (Step S101).

In Step S101, when it is determined that the vehicle speed is equal to or lower than the predetermined value (specifically, Yes), the engine automatic-stop determination section 31 determines whether or not an empirical vehicle speed after the automatic stop of the engine is performed is larger than a predetermined value (Step S102).

The condition corresponding to the empirical vehicle speed is a precondition for performing the automatic stop and the automatic restart of the engine without inappropriately draining a battery by, for example, repeating a running pattern of creeping, engine automatic-stop, engine automatic-restart, creeping, and engine automatic restart in a traffic jam. For the empirical vehicle speed, a vehicle speed (for example, 10 km/h), at which it can be determined that the vehicle gets out of the traffic jam and transits from a creeping state to a normal running state in which the accelerator pedal is pressed, is set as a predetermined value.

In Step S102, when it is determined that the empirical vehicle speed after the automatic stop of the engine is performed is larger than the predetermined value (specifically, Yes), the engine automatic-stop determination section 31 determines whether or not the brake signal is an ON state, specifically, the driver is pressing down the brake pedal (Step S103).

In Step S103, when it is determined that the brake signal is ON (specifically, Yes), the engine automatic-stop determination section 31 determines that the engine automatic-stop conditions are satisfied and therefore starts engine automatic-stop control (Step S104).

At this time, the engine automatic-stop determination section 31 stops the fuel supply to the engine by fuel-injection control and stops the ignition of the engine by ignition control.

Subsequently, the engine automatic-stop determination section 31 determines that the engine is in a stopped state and sets an engine automatic-stop state flag to 1 (Step S105).

Next, the engine restart determination section 32 determines whether or not the engine restart conditions (for example, the release of the driver's foot from the brake pedal) are satisfied in accordance with the accelerator opening-degree signal from the accelerator opening-degree sensor 12 and the brake signal from the brake unit 15, which are input to the engine ECU 10, after the engine is stopped or while the engine rpm is decreasing as a result of the rotation by inertia (Step S106).

Figure 5:
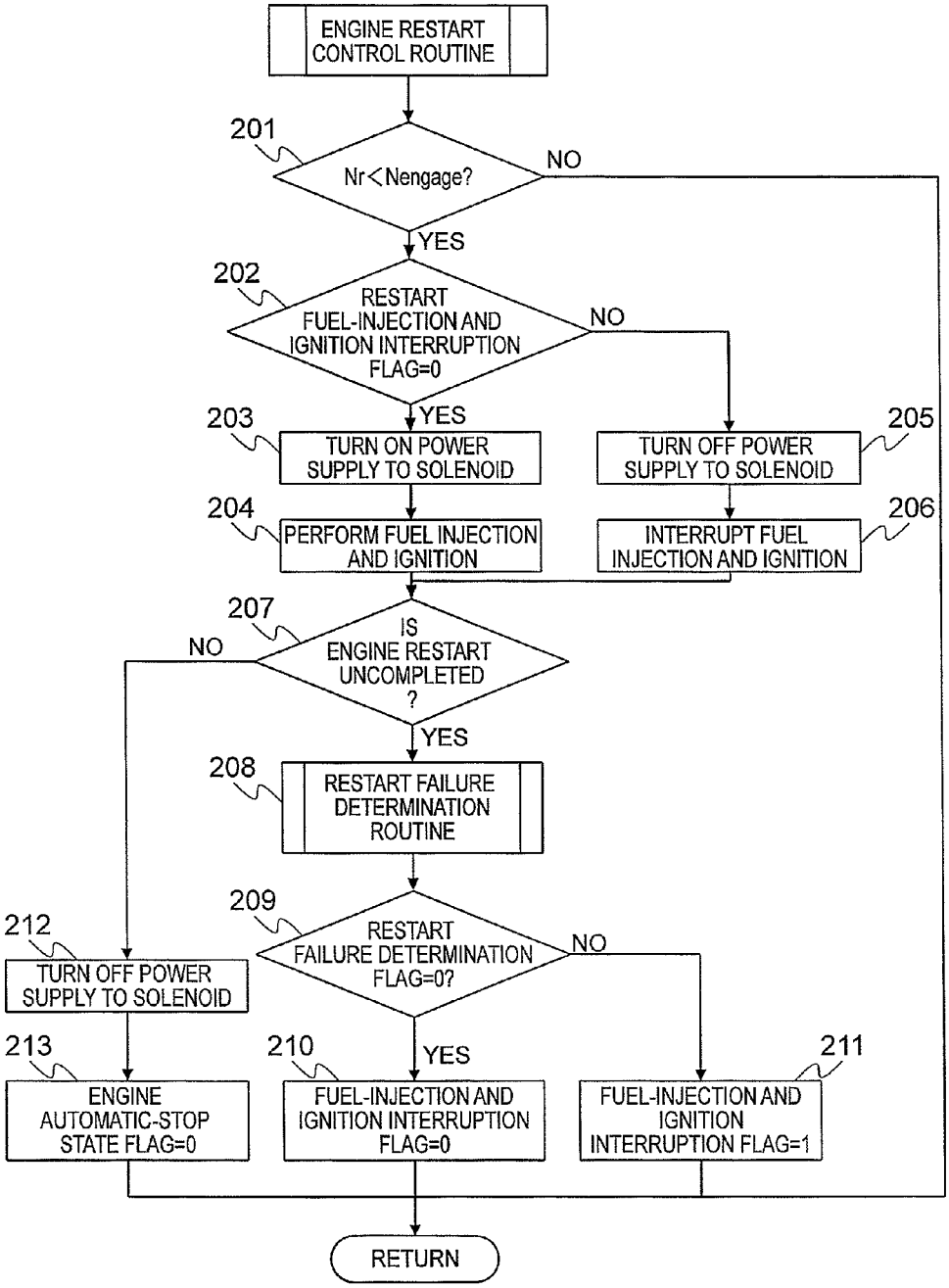
FIG. 5 is a flowchart illustrating a flow of an engine restart control routine performed in the engine controller according to the first embodiment of the present invention.

In Step S106, when it is determined that the engine restart conditions are satisfied (specifically, Yes), the processing jumps to an engine restart control routine illustrated in FIG. 5 (Step S107). Then, the processing illustrated in FIG. 4 is terminated.

On the other hand, when it is determined in Step S106 that the engine restart conditions are not satisfied (specifically, No), the processing illustrated in FIG. 4 is directly terminated.

Moreover, when it is determined that the engine restart conditions are satisfied, the determination of the satisfaction of the engine restart conditions is continued until the completion of the restart of the engine is determined.

When it is determined in Step S101 that the vehicle speed is larger than the predetermined value (specifically, No), it is determined in Step S102 that the empirical vehicle speed after the automatic-stop operation of the engine is performed is equal to or smaller than the predetermined value (specifically, No), or it is determined in Step S103 that the brake signal is not ON (specifically, No), the engine automatic-stop determination section 31 determines whether or not the engine automatic-stop state flag is 1 (Step S108).

In Step S108, when it is determined that the engine automatic-stop state flag is 1 (specifically, Yes), the processing proceeds to Step S106.

On the other hand, in Step S108, when it is determined that the engine automatic-stop state flag is 0 (specifically, No), the engine automatic-stop determination section 31 determines that the engine is not in an engine halt state and therefore terminates the processing illustrated in FIG. 4.

FIG. 5 is a flowchart illustrating a flow of an engine restart control routine performed in the engine controller according to the first embodiment of the present invention.

First, the engine restart determination section 32 determines whether or not an engine rpm Nr is smaller than a predetermined rpm Nengage (for example, 80 rpm) at which the pinion gear 244 and the ring gear 23 can be brought into meshing engagement with each other (Step S201).

In Step S201, when it is determined that the engine rpm Nr is smaller than the predetermined rpm Nengage at which the pinion gear 244 and the ring gear 23 can be brought into engagement with each other (specifically, Yes), the engine restart determination section 32 determines that the pinion gear 244 and the ring gear 23 can be brought into engagement with each other and then, determines whether or not a fuel-injection and ignition interruption flag described below is 0 (Step S202).

On the other hand, in Step S201, when it is determined that the engine rpm Nr is equal to or larger than the predetermined rpm Nengage at which the pinion gear 244 and the ring gear 23 can be brought into meshing engagement with each other (specifically, No), the engine restart determination section 32 determines that the meshing engagement of the pinion gear 244 and the ring gear 23 is impossible, therefore terminates the processing illustrated in FIG. 5, and returns to the fuel-cut control routine.

In Step S202, when it is determined that the fuel-injection and ignition interruption flag is 0 (specifically, Yes), the engine restart determination section 32 turns ON power supply to the solenoid 241 (Step S203).

When the power is turned ON, an attracting force is generated between the solenoid 241 and the plunger 242, and hence, the plunger 242 moves in an axial direction. As a result, the pinion gear 244 moves in the axial direction through an intermediation of the lever 243. Then, the meshing engagement of the pinion gear 244 and the ring gear 23 is started. Further, the contact is closed by the movement of the plunger 242. As a result, the starter motor 245 is energized.

Subsequently, the engine restart determination section 32 performs the fuel injection and the ignition (Step S204).

On the other hand, when it is determined in Step S202 that the fuel-injection and ignition interruption flag is 1 (specifically, No), the engine restart determination section 32 turns OFF the power supply to the solenoid 241 (Step S205).

Next, the engine restart determination section 32 interrupts the fuel injection and the ignition (Step S206).

Subsequently, the engine restart determination section 32 determines whether or not the restart of the engine is uncompleted (Step S207). For the determination of completion/incompletion of the restart of the engine, it is determined that the restart of the engine is completed when the engine rpm Nr after the satisfaction of the engine restart conditions is larger than a predetermined value (for example, 500 rpm), whereas it is determined that the restart of the engine is uncompleted when the engine rpm Nr is equal to or smaller than the predetermined value.

Figure 7:
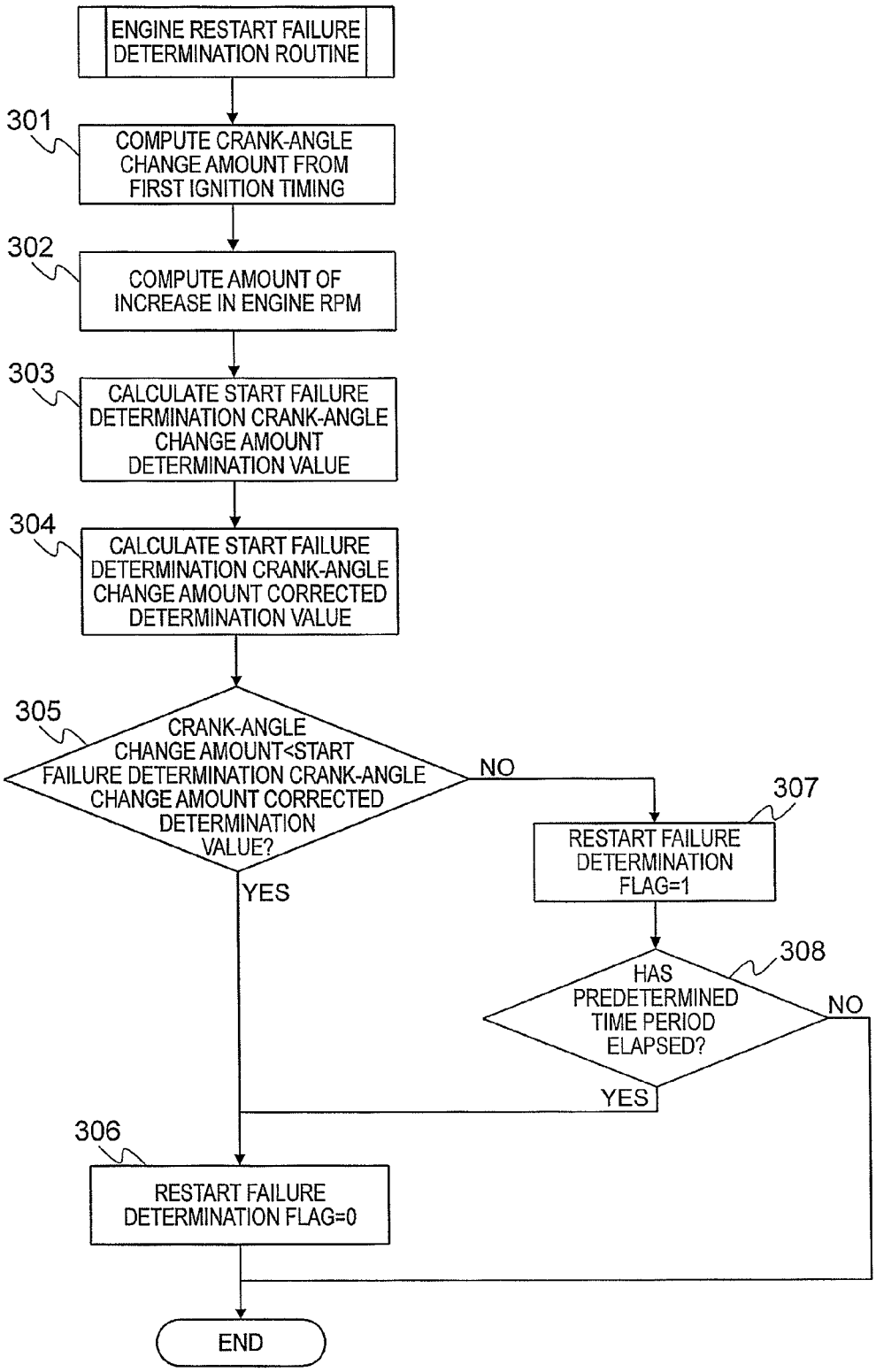
FIG. 7 is a flowchart illustrating a flow of an engine restart failure determination routine performed in the engine controller according to the first embodiment of the present invention.

In Step S207, when it is determined that the restart of the engine is uncompleted (specifically, Yes), the processing jumps to a restart failure determination routine illustrated in FIG. 7 (Step S208).

Next, the engine restart determination section 32 determines whether or not a restart failure determination flag described below is 0 (Step S209).

In Step S209, when it is determined that the restart failure determination flag is 0 (specifically, Yes), the engine restart determination section 32 resets the fuel-injection and ignition interruption flag to 0 (Step S210), terminates the processing illustrated in FIG. 5, and returns to the fuel-cut control routine.

On the other hand, when it is determined in Step S209 that the restart failure determination flag is 1 (specifically, No), the engine restart determination section 32 sets the fuel-injection and ignition interruption flag to 1 (Step S211), terminates the processing illustrated in FIG. 5, and returns to the fuel cut-off control routine.

When it is determined in Step S207 that the restart of the engine is completed (specifically, No), the engine restart determination section 32 turns OFF the power supply to the solenoid 241 (Step S212), resets the engine automatic-stop state flag to 0 (Step S213), terminates the processing illustrated in FIG. 5, and returns to the fuel cut-off control routine.

Figure 6:
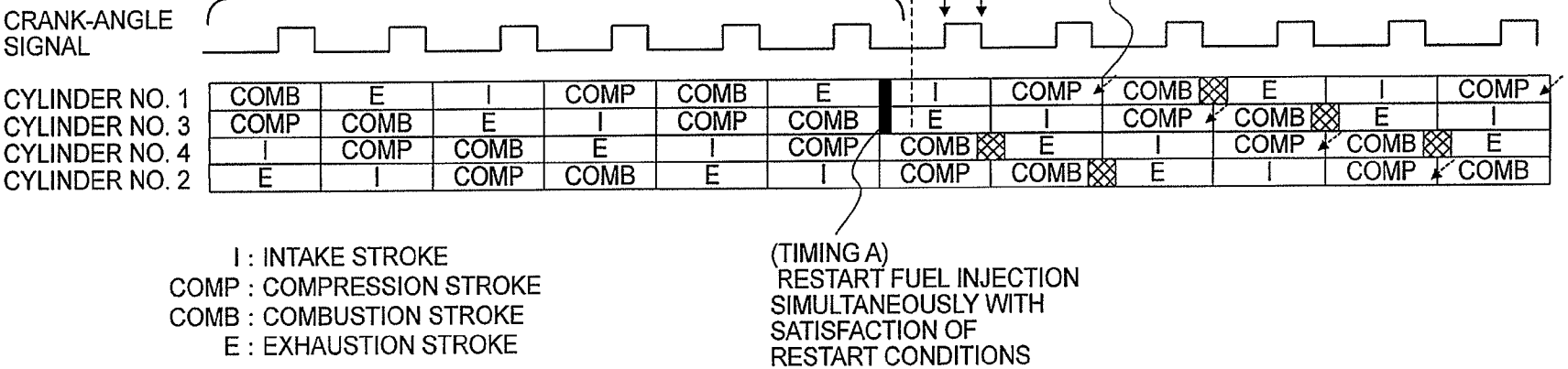
FIG. 6 is an explanatory diagram illustrating fuel-injection control and ignition control in engine automatic stop/restart control by the engine controller according to the first embodiment of the present invention.

The fuel injection control and the ignition control in the engine automatic stop/restart control by the engine controller according to the first embodiment of the present invention is now described with reference to FIG. 6. FIG. 6 shows fuel-injection timings and ignition timings of a four-cylinder engine. The fuel injection control and the ignition control are interrupted in the engine halt state.

For the fuel injection, after the engine restart conditions are satisfied, the fuel is injected into a plurality of predetermined cylinders (for example, a cylinder in an intake stroke and a cylinder in an exhaustion stroke) simultaneously with the turn-ON of power supply to the solenoid (timing A shown in FIG. 6). Thereafter, the fuel injection is performed at a predetermined timing, for example, at each crank angle B05° CA in a combustion stroke (hatched area shown in FIG. 6).

For the ignition, the ignition is restarted at a first ignition timing at which the fuel in the cylinder, which can be first combusted at the restart (fuel injected into a cylinder No. 1 which is in the intake stroke at the timing A in FIG. 6), is combusted after the fuel is injected into the plurality of predetermined cylinders simultaneously with the turn-ON of power supply to the solenoid described above. More specifically, the ignition is restarted at each crank angle B05° CA during the compression stroke when a timing indicated by the arrow in solid line shown in FIG. 6 is the first ignition timing. The ignition timing after the first ignition timing is indicated by a broken line.

FIG. 7 is a flowchart illustrating a flow of an engine restart failure determination routine performed in the engine controller according to the first embodiment of the present invention.

First, the crank-angle change amount computing section 34 computes a crank-angle change amount from the first ignition timing after the engine restart conditions are satisfied (Step S301).

Subsequently, the engine-rpm increase amount computing section 38 computes the amount of increase in engine rpm (hereinafter, referred to as "engine-rpm increase amount") by the first ignition of the engine (Step S302).

Next, the start failure determination crank-angle change amount determination value setting section 39 calculates the start failure determination crank-angle change amount determination value based on the engine-rpm increase amount at the time of the first ignition (step S303).

Figure 8:
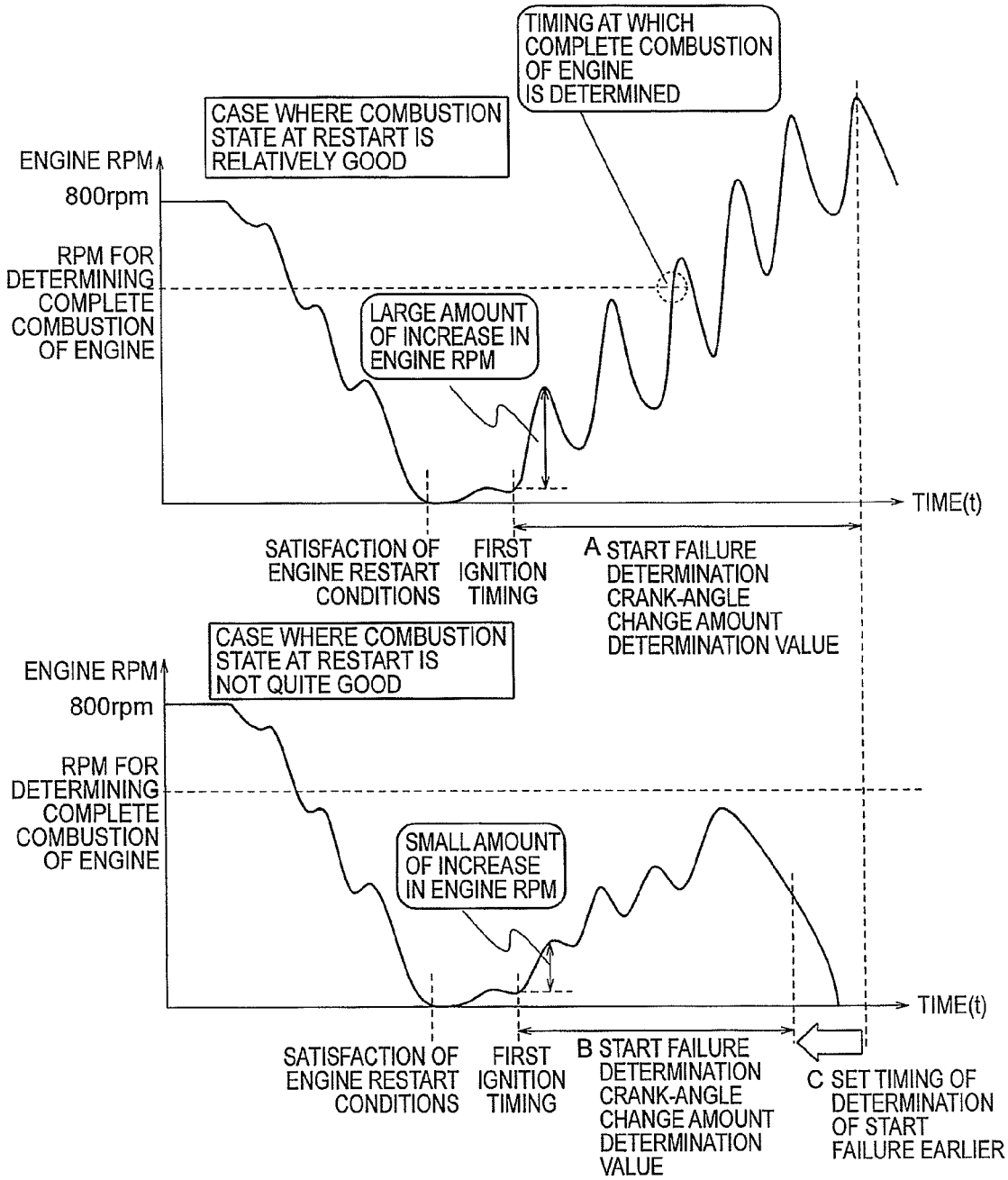
FIG. 8 is an explanatory diagram for illustrating a difference in determination timing between the case where a combustion state at engine restart is relatively good and the case where the combustion state is not good, in the automatic stop/restart control of the engine controller according to the first embodiment of the present invention.

FIG. 8 is an explanatory diagram illustrating a difference in determination timing when the restart failure is determined between the case where a combustion state at the engine restart is relatively good and the case where the combustion state is not good in the engine automatic-stop/restart control performed by the engine controller according to the first embodiment of the present invention.

In FIG. 8, in the case where a high possibility of the restart failure can be determined because the engine-rpm increase amount is small at the first ignition and the combustion is not good, the start failure determination crank-angle change amount determination value is set smaller (see B shown in FIG. 8) than the value (see A shown in FIG. 8) in the case where the engine-rpm increase amount is relatively large at the time of the first ignition and the combustion is relatively good. In this manner, a criterion of the determination of the start failure is tightened. As a result, in the case where the combustion state at the restart is not good, the determination of a restart failure can be made earlier (see C shown in FIG. 8) than in the case where the combustion state is relatively good.

Figure 9:
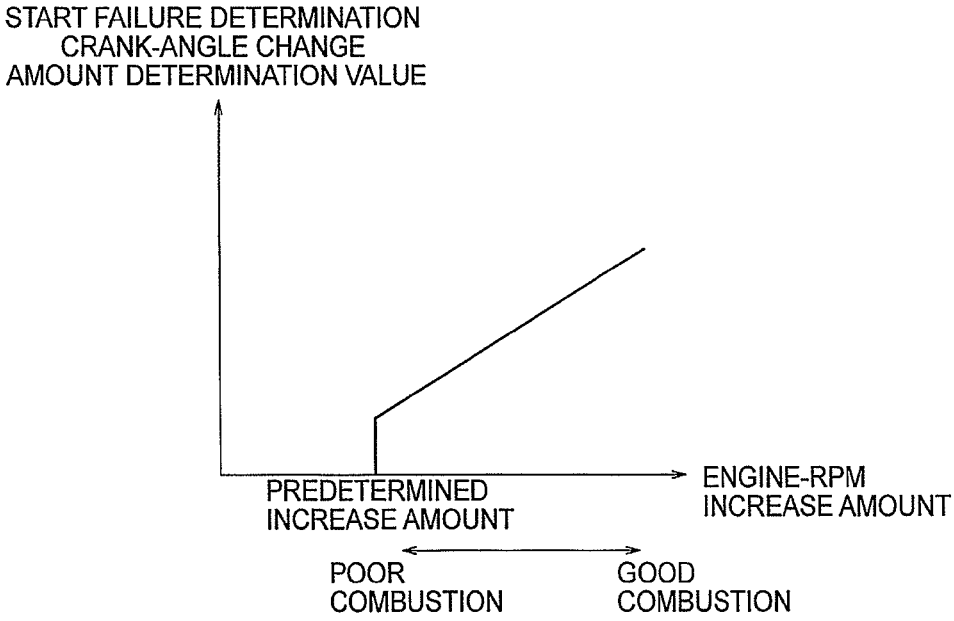
FIG. 9 is an explanatory diagram illustrating a control map for setting a start failure determination crank-angle change amount determination value in the engine automatic stop/restart control of the engine controller according to the first embodiment of the present invention.

More specifically, the start failure determination crank-angle change amount determination value is set in accordance with a map with the X axis indicating the engine-rpm increase amount and the Y axis indicating the start failure determination crank-angle change amount determination value, as indicated on the control map of FIG. 9. As a value for the control map, data such as the engine-rpm increase amount at the time of the first ignition and the crank-angle change amount from the first ignition timing until the engine complete combustion determination rpm (500 rpm) is acquired in various restart cases such as a normal restart and a restart failure in the vehicle so as to derive an optimal value allowing the determination of the restart failure without causing any delay in the determination of the start failure or any erroneous determination.

On the control map, in a region in which the engine-rpm increase amount is smaller than a predetermined increase amount, the start failure determination crank-angle change amount determination value is set remarkably small (for example, in the vicinity of zero) than that in the case where the increase in engine rpm is equal to or larger than the preset predetermined increase amount so as to determine a start failure immediately after the determination for the start failure is started. The setting of the start failure determination crank-angle change amount determination value as described above is to immediately determine the restart failure in the case where the engine-rpm change amount is such a small amount that the restart failure is obviously brought about. The predetermined increase amount is set to about 50 rpm, which can be experimentally obtained from the results obtained in the case where the vehicle actually fails in starting.

Returning to FIG. 7, the start failure determination crank-angle change-amount determination value setting section 39 calculates a correction factor in accordance with the battery voltage and the intake-pipe pressure at the time of the engine restart and multiplies the start failure determination crank-angle change amount determination value calculated in Step S303 by the calculated correction factor so as to calculate a start failure determination crank-angle change amount corrected determination value (Step S304).

Figure 10:
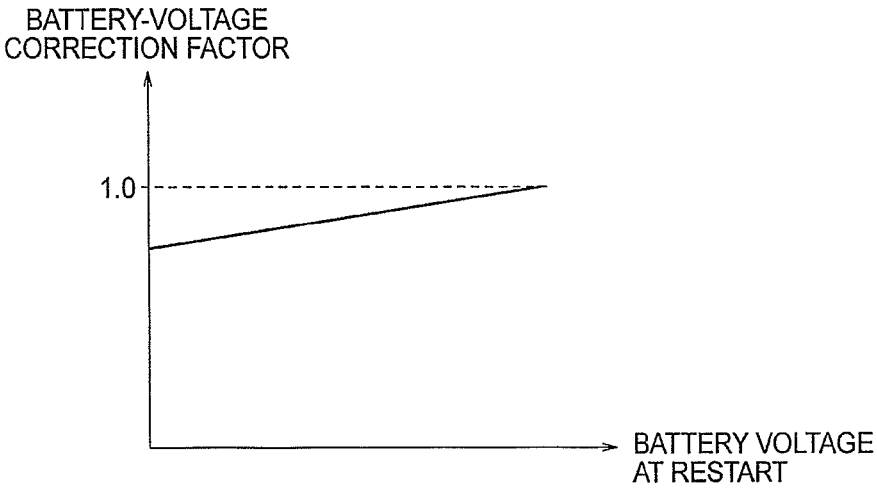
FIG. 10 is an explanatory diagram illustrating a control map for setting a battery-voltage correction factor in the engine automatic stop/restart control of the engine controller according to the first embodiment of the present invention.

More specifically, at the time of the restart of the engine, a driving force of the starter at the restart greatly affects the success/failure in restart. Therefore, as the battery voltage becomes lower (the driving force of the starter becomes smaller), the correction factor is set to a value for correction to the negative side, as shown in FIG. 10. In this manner, the criterion of determination of the start failure is tightened to set the timing of determination of the start failure earlier.

Figure 11:
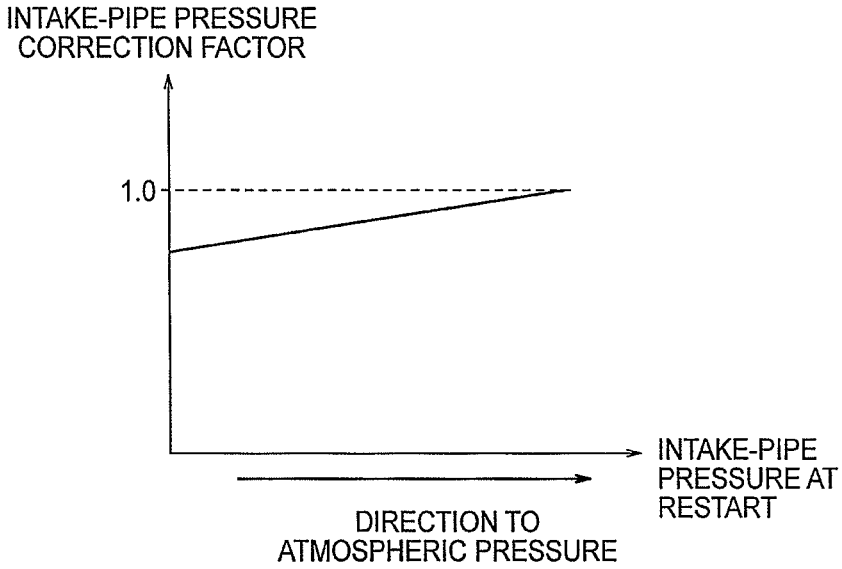
FIG. 11 is an explanatory diagram illustrating a control map for setting an intake-pipe pressure correction factor in the engine automatic stop/restart control of the engine controller according to the first embodiment of the present invention.

Moreover, the intake-pipe pressure at the restart greatly affects the success/failure in restart of the engine. Therefore, as the intake-pipe pressure becomes lower (the amount of air becomes smaller), the correction factor is set for the correction to the negative side, as shown in FIG. 11. In this manner, the criterion of the determination of the start failure is tightened to set the timing of determination of the start failure earlier.

Returning to FIG. 7, the start failure determination crank-angle change amount determination value setting section 39 determines whether or not the crank-angle change amount from the first ignition timing, which is calculated in Step S301, is smaller than the start failure determination crank-angle change amount corrected determination value (Step S305).

In Step 305, when it is determined that the crank-angle change amount is smaller than the start failure determination crank-angle change amount corrected determination value (specifically, Yes), the start failure determination crank-angle change amount determination value setting section 39 determines that the start has not failed, resets the restart failure determination flag to 0 (step S306), terminates the processing illustrated in FIG. 7, and returns to the engine restart control routine.

On the other hand, when it is determined in Step S305 that the crank-angle change amount is equal to or larger than the restart failure determination crank-angle change amount corrected determination value (specifically, No), the start failure determination crank-angle change amount determination value setting section 39 determines that the start has failed and sets the restart failure determination flag to 1 (Step S307).

Subsequently, the start failure determination crank-angle change amount determination value setting section 39 measures an elapsed time period after the restart failure determination flag is set from 0 to 1 in Step S307 and then determines whether the elapsed time period is equal to or longer than a predetermined time period that is set in advance (Step S308). Here, the predetermined time period is a time period within which the engine rotation after the restart failure is completely stopped (about 100 to 200 ms).

When it is determined in Step S308 that the elapsed time period is equal to or longer than the predetermined time period (specifically, Yes), the processing proceeds to Step S306 where the restart failure determination flag is reset to 0. Then, after the processing illustrated in FIG. 7 is terminated, the processing returns to the engine restart control routine.

On the other hand, when it is determined in Step S308 that the elapsed time period is not equal to or longer than the predetermined time period (specifically, No), the processing illustrated in FIG. 7 is directly terminated. Then, the processing returns to the engine restart control routine.

Figure 12:
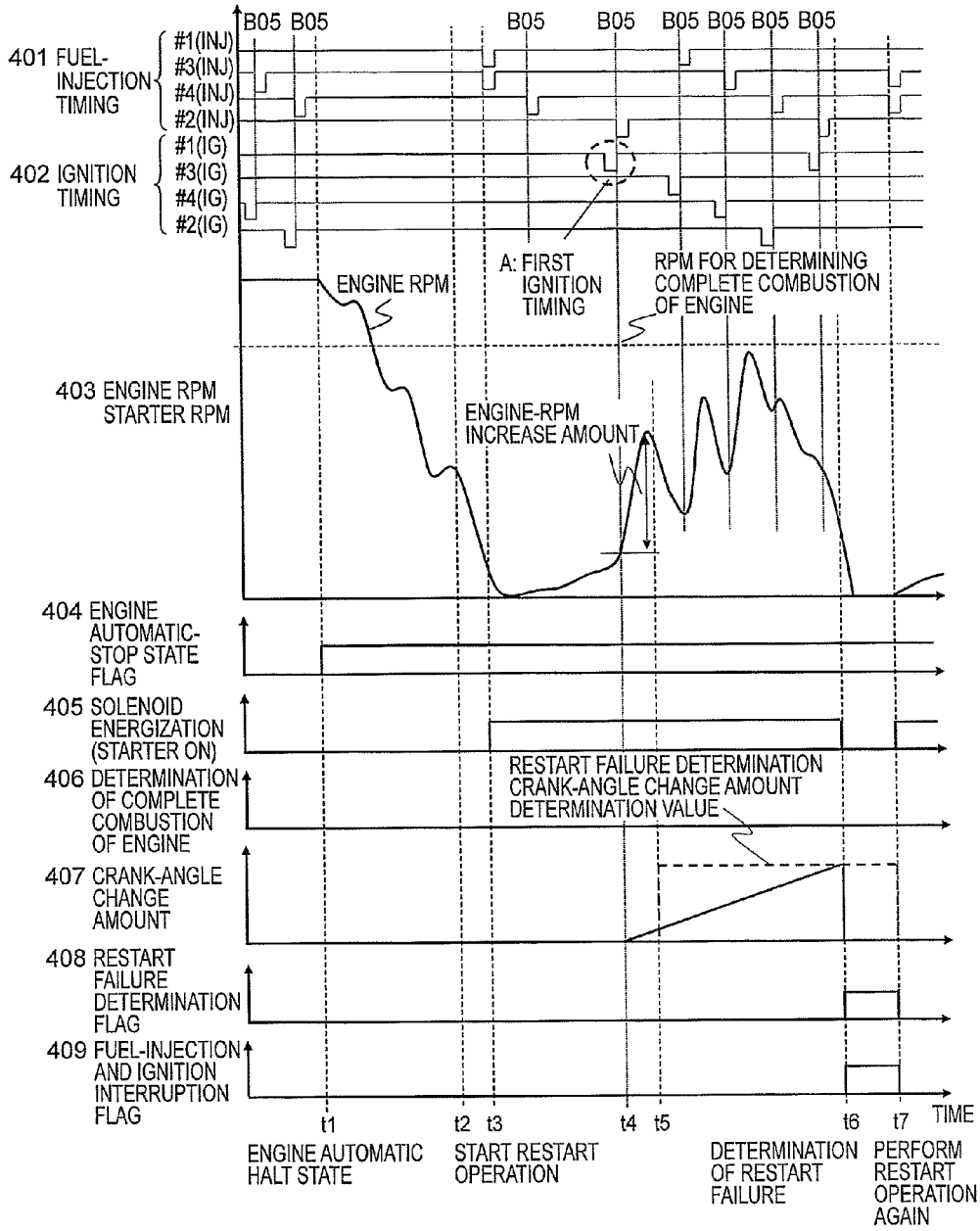
FIG. 12 is a timing chart illustrating an example of an operation in the engine automatic stop/restart control of the engine controller according to the first embodiment of the present invention.
Figure 13:
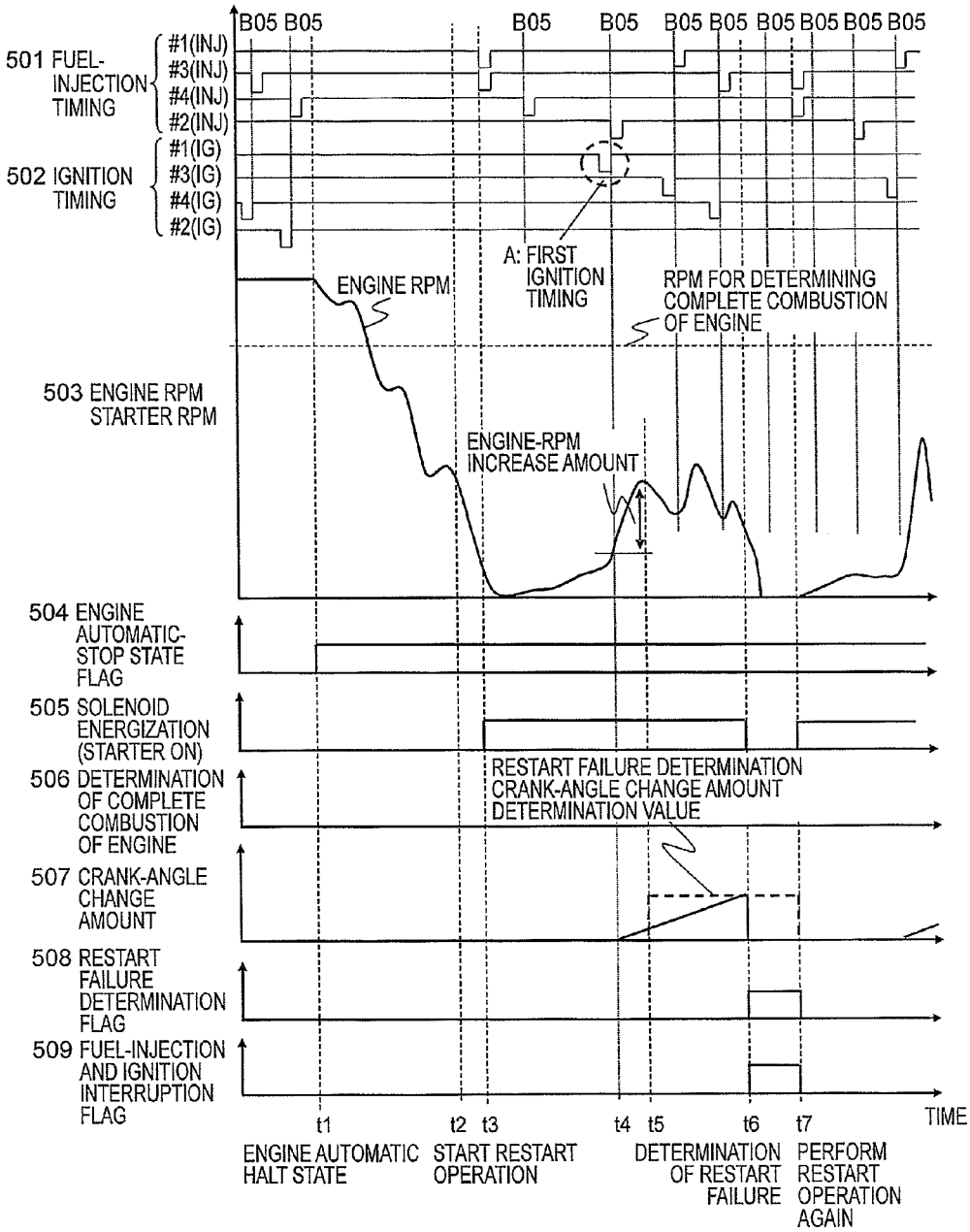
FIG. 13 is another timing chart illustrating the example of the operation in the engine automatic stop/restart control of the engine controller according to the first embodiment of the present invention.
Figure 14:
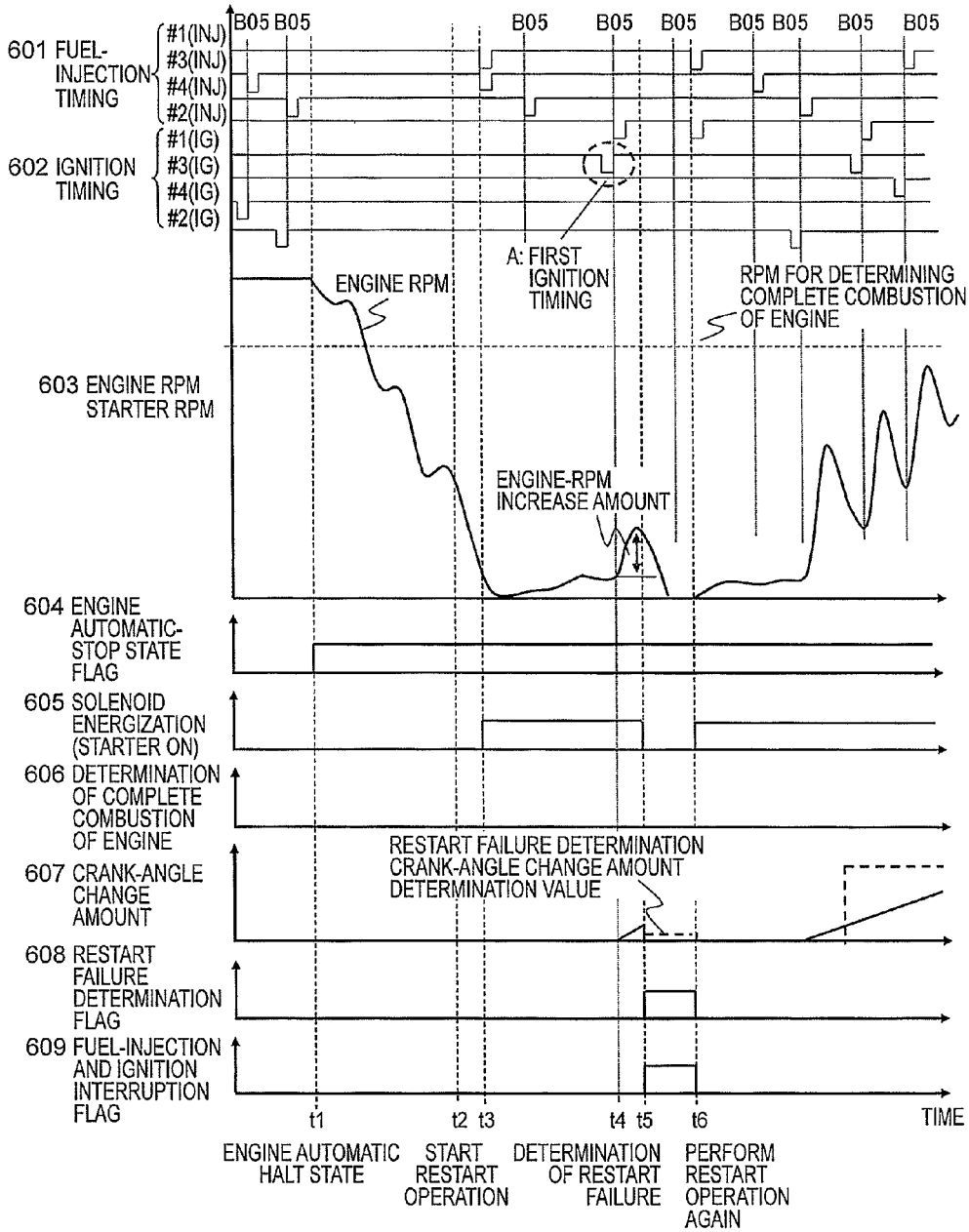
FIG. 14 is a still another timing chart illustrating the example of the operation in the engine automatic stop/restart control of the engine controller according to the first embodiment of the present invention.
Figure 15:
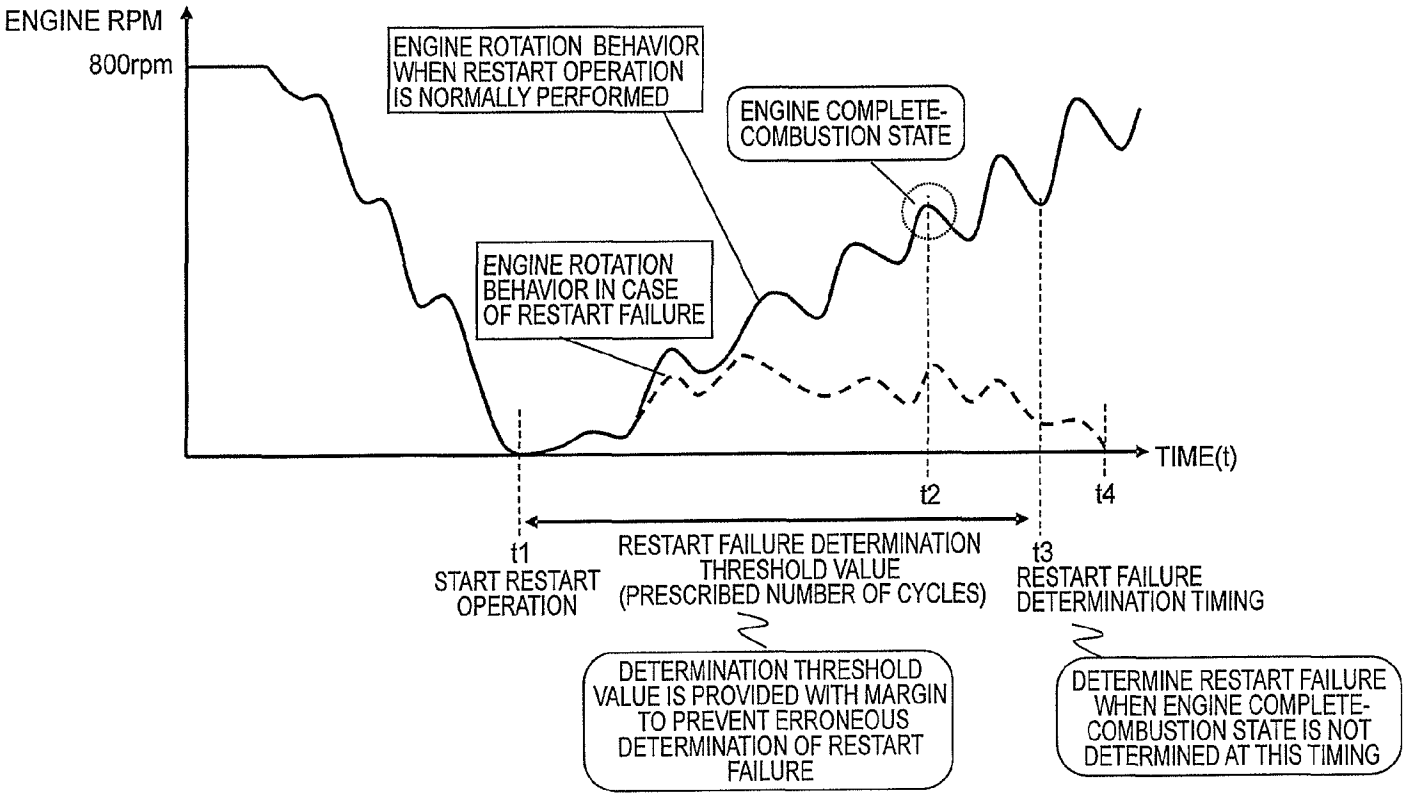
FIG. 15 is an image diagram for illustrating an operation and problems of a conventional start control device for an engine.

Next, with reference to timing charts of FIGS. 12, 13, and 14, an example of an operation in the engine automatic-stop/restart control performed by the engine controller according to the first embodiment of the present invention is described. Each of FIGS. 12 to 14 illustrates an operation in the following case. The engine automatic-stop operation is performed in a vehicle running state. The power supply to the solenoid 241 is turned ON to perform the engine restart after the engine restart conditions are satisfied. However, the complete combustion of the engine is not determined and the restart has failed. Then, the restart operation is subsequently performed again.

In FIGS. 12 to 14, a part 401 shows a fuel injection timing of each cylinder of the engine, a part 402 shows an ignition timing of each cylinder of the engine, and a part 403 shows a temporal transition of the engine rpm.

A part 404 shows the engine automatic-stop state flag. The engine automatic-stop state flag is set to 1 while the engine is in an automatic halt state, and is reset to 0 when the restart is completed. Apart 405 shows an energized state of the solenoid 241. When the solenoid 241 is energized, specifically, the starter motor 245 is in an ON state, a value of the part 405 is set to 1. A part 406 shows the engine complete-combustion determination flag. The engine complete-combustion determination flag is reset to 0 when the engine rpm after the start of the restart operation is equal to or smaller than a predetermined rpm (500 rpm) and is set to 1 when the engine rpm is larger than the predetermined rpm (500 rpm).

A part 407 shows the crank-angle change amount (solid line) from the first ignition timing after the restart operation is started and the start failure determination crank-angle change amount determination value (broken line) set in accordance with the engine-rpm increase amount. A part 408 shows the restart failure determination flag. The restart failure determination flag is set to 1 when it is determined that the restart has failed and is reset to 0 when it is not determined that the restart has failed or after the elapse of a predetermined time period from the time at which the restart failure flag is set to 1. A part 409 shows the fuel-injection and ignition interruption flag. The fuel-injection and ignition interruption flag is set to 1 at the time when the restart failure determination flag is set to 1 and is reset to 0 at the time when the restart failure determination flag is reset to 0.

First, with reference to the timing chart of FIG. 12, an example of the operation in the case where the complete combustion of the engine is not determined and the start has failed although the engine-rpm increase amount is relatively large (the combustion state is relatively good) at the first ignition timing when the restart is performed is described.

In FIG. 12, first, at a time t1 at which the engine automatic-stop conditions are satisfied while the vehicle is running, the engine automatic-stop state flag 404 is set to 1. Subsequently, the engine restart conditions (for example, the release of the driver's foot from the brake pedal and the like) are satisfied at a time t2.

Next, at a time t3 at which the engine rpm Nr becomes smaller than the predetermined rpm difference Nengage allowing the pinion gear 244 and the ring gear 23 to be brought into meshing engagement with each other, the energization of the solenoid 241 is started. As a result, the pinion gear 244 and the ring gear 23 are brought into meshing engagement with each other, and hence the starter motor 245 starts driving. Simultaneously with the start of the energization of the solenoid 241, the first fuel injection is restarted for the plurality of predetermined cylinders. Subsequently, the fuel injection is performed at each crank angle B05° CA during the combustion stroke.

Next, at a time t4, which is a timing at which the first injected fuel injected at the time t3 can be combusted, the ignition (first ignition) is started. Subsequently, the ignition is restarted at each crank angle B05° CA during the compression stroke. The computation of the crank-angle change amount from the first ignition timing is started.

Next, at a time t5, the start failure determination crank-angle change amount determination value is set in accordance with the amount of increase in engine rpm, which is generated by the combustion at the first ignition timing corresponding to the time t4. When the engine-rpm increase amount is relatively large as in this case, the possibility of the restart failure is estimated to be low. The criterion of the determination of the restart failure is eased (the start failure determination crank-angle change amount determination value is set to a large value with a margin). In. this manner, the erroneous determination of the restart failure can be prevented.

Subsequently, from the time t5 to a time t6, the crank-angle change amount increases by the increase in engine rpm. At the time t6, the crank-angle change amount becomes larger than the start failure determination crank-angle change amount determination value. Therefore, the restart failure determination flag is set to 1, the fuel-injection and ignition interruption flag is set to 1, and the power supply to the solenoid 241 is turned OFF. By setting the fuel-injection and ignition interruption flag to 1, the fuel injection and the ignition are interrupted.

When the possibility of the restart failure is thus estimated to be low, the criterion of the determination of the restart failure is eased as described above. Therefore, an erroneous determination, specifically, the case where the restart failure is erroneously determined even though the restart failure is not brought about, can be suppressed.

Next, at a time t7, the elapsed time period from the time point (time t6) at which the restart failure flag is set to 1 becomes equal to or longer than the predetermined time period. Therefore, simultaneously with the energization of the solenoid 241 to perform the restart operation again, the fuel is injected into the plurality of predetermined cylinders.

Next, with reference to the timing chart of FIG. 13, an example of the operation in the case where the complete combustion of the engine is not determined and the start has failed because the engine-rpm increase amount is small (the combustion state is not good) at the first ignition timing when the restart is performed is described.

An operation from the time t1 to the time t4 is the same as that shown in the timing chart of FIG. 12. Therefore, the description thereof is herein omitted, and the operation after the time t5, which is different from that shown in FIG. 12, is described.

First, the ignition (first ignition) is started after the restart operation is started. The ignition is restarted at each crank angle B05° CA during the compression stroke. After the computation of the crank-angle change amount from the first ignition timing is started, the start failure determination crank-angle change amount determination value is set in accordance with the amount of increase in engine rpm, which is generated by the combustion at the first ignition timing corresponding to the time t5. When the engine-rpm increase amount is small as in this case, the possibility of the restart failure is estimated to be high. Therefore, the criterion of the determination of the restart failure is tightened (the start failure determination crank-angle change amount determination value is set to a small value).

Subsequently, from the time t5 to the time t6, the crank-angle change amount increases by the increase in engine rpm. At the time t6, the crank-angle change amount becomes larger than the start failure determination crank-angle change amount determination value. Therefore, the restart failure determination flag is set to 1.

At this time, as compared with the start failure determination timing (time t6 shown in FIG. 12) in the case where the engine-rpm increase amount is relatively large, the criterion of the determination of the restart failure is tightened (the start failure determination crank-angle change amount determination value is set to a smaller value) to set the timing of determination of the restart failure earlier. Therefore, in the case where the engine-rpm increase amount at the first ignition timing is small (the combustion state is not good) and therefore the possibility of restart failure is estimated to be high, the restart failure can be determined at an earlier timing.

Next, at the time t7, the elapsed time period from the time point (time t6) at which the restart failure flag is set to 1 becomes equal to or longer than the predetermined time period. Therefore, simultaneously with the energization of the solenoid 241 to perform the restart operation again, the fuel is injected into the plurality of predetermined cylinders. At this time, as compared with the restart-operation restart timing (time t7 shown in FIG. 13) in the case where the engine-rpm increase amount is relatively large, the timing of restart of the restart operation can be set earlier.

The start failure determination crank-angle change amount determination value derived at the time t5 is set to the start failure determination crank-angle change amount corrected determination value (not shown) which is corrected in a direction in which the criterion of the determination of the restart failure becomes tighter (the start failure determination crank-angle change amount determination value is set smaller) in accordance with the battery voltage at the restart. As a result, in the case where the battery voltage is low and therefore the driving force of the starter motor required for the restart is not ensured, the restart failure can be determined at an earlier timing.

The start failure determination crank-angle change amount determination value derived at the time t5 is set to the start failure determination crank-angle change amount corrected determination value (not shown) which is corrected in a direction in which the criterion of the determination of the restart failure becomes tighter (the start failure determination crank-angle change amount determination value is set smaller) in accordance with the intake-pipe pressure at the restart. As a result, in the case where the intake-pipe pressure is low and therefore the amount of air required for the restart is not ensured, the restart failure can be determined at an earlier timing.

Next, with reference to the timing chart of FIG. 14, an example of the operation in the case where the complete combustion of the engine is not determined and the start has failed because the engine-rpm increase amount is extremely small (the combustion state is insufficient) at the first ignition timing when the restart is performed is described.

An operation from the time t1 to the time t4 is the same as that shown in the timing chart of FIG. 12. Therefore, the description thereof is herein omitted, and the operation after the time t5, which is different from that shown in FIG. 12, is described.

First, the ignition (first ignition) is started after the restart operation is started. The ignition is restarted at each crank angle B05° CA during the compression stroke. After the computation of the crank-angle change amount from the first ignition timing is started, the start failure determination crank-angle change amount determination value is set in accordance with the amount of increase in engine rpm, which is generated by the combustion at the first ignition timing corresponding to the time t5. When the engine-rpm increase amount is smaller than a predetermined increase amount as in this case, the start failure determination crank-angle change amount determination value is set smaller (for example, in the vicinity of zero).

Therefore, the crank-angle change amount becomes larger than the start failure determination crank-angle change amount determination value (in the vicinity of zero) at the time t5. Thus, the restart failure determination flag is set to 1. At this time, as compared with the start failure determination timing (time t6 shown in FIG. 13) in the case where the engine-rpm increase amount is small, the determination of the restart failure is made immediately after the engine-rpm increase amount is detected. Therefore, the restart failure can be determined at a further earlier timing.

Subsequently, at a time t6, the elapsed period of time from the time (time t5) at which the restart failure flag is set to 1 becomes longer than the predetermined period of time. Therefore, simultaneously with the energization of the solenoid 241 to restart the restart operation, the fuel is injected into the plurality of predetermined cylinders. At this time, as compared with the restart-operation restart timing (time t7 shown in FIG. 14) in the case where the engine-rpm increase amount is small, the timing at which the restart operation is restarted can be set further earlier.

As described above, the start failure determination crank-angle change amount determination value serving as the determination threshold value for the determination of the restart failure is set in accordance with the engine-rpm increase amount at the first ignition timing at the restart. Therefore, in the case where the engine-rpm increase amount is large and therefore the possibility of the restart failure is estimated to be low, the determination threshold value is eased to prevent an erroneous determination of the restart failure. On the other hand, in the case where the engine-rpm increase amount is small and therefore the possibility of the restart failure is estimated to be high, the determination threshold value is tightened to set the timing of determination of the restart failure earlier. In the case where the engine-rpm increase amount is extremely small and therefore the restart failure can be immediately determined, the criterion threshold value is set further tighter (in the vicinity of zero) so as to set the timing of determination of the restart failure further earlier.

Moreover, in the case where the battery voltage at the restart is low and therefore it is determined that the driving force of the starter motor required for the restart cannot be ensured or in the case where the intake-pipe pressure at the restart is low and therefore it is determined that the amount of air required for the restart cannot be ensured, the possibility of restart failure is estimated to be high. Therefore, the criterion threshold value is set tighter (the start failure determination crank-angle change amount determination value is set further smaller). As a result, whether or not the restart has failed can be determined at an earlier timing.

Moreover, as described above, the restart operation can be restarted quicker after the determination of the restart failure as a result of a reduced delay in determination for the restart failure. Therefore, a feeling of discomfort (delay in restart) felt by the driver as a result of the restart failure can be reduced.

As described above, according to the first embodiment, the engine-rpm increase amount computing section computes the amount of increase in engine rpm by the first ignition of the engine after the restart conditions are satisfied. The start failure determination crank-angle change amount determination value setting section sets the restart failure determination threshold value based on the computed amount of increase in engine rpm. The restart failure determination section determines the restart has failed when the crank-angle change amount from the first ignition timing for the engine after the restart conditions are satisfied becomes larger than the restart failure determination threshold value although the complete combustion of the engine is not determined. Therefore, the restart operation of the engine is interrupted. After elapse of the predetermined period of time, the restart operation of the engine is restarted.

Therefore, the following engine controller and the engine control method can be obtained. The restart failure is determined based on the restart failure determination threshold value set in accordance with the combustion state at the restart. A result, the restart failure is quickly determined while preventing an erroneous determination. When the restart failure is determined, the restart operation can be restarted without giving a feeling of discomfort (feeling of delay in restart) to the driver.

What is claimed is:

1. An engine controller including an engine automatic-stop/restart device for automatically stopping an engine when an engine automatic-stop condition is satisfied and restarting the engine when a restart condition is subsequently satisfied, comprising:

a crank-angle sensor for detecting a crank angle of a crankshaft of the engine;

an engine-rpm computing section for computing an engine rpm based on the crank angle;

a crank-angle change amount computing section for computing a crank-angle change amount based on the crank angle;

an engine complete-combustion determination section for determining a complete combustion of the engine when the engine rpm becomes larger than a preset predetermined rpm after the restart condition is satisfied;

an engine-rpm increase amount computing section for computing an amount of increase in the engine rpm, generated by first ignition of the engine after the restart condition is satisfied;

a start failure determination crank-angle change amount determination value setting section for setting a restart failure determination threshold value based on the amount of increase in the engine rpm; and a restart failure determination section for determining a restart failure when the crank-angle change amount from a first ignition timing of the engine after the satisfaction of the restart condition becomes larger than the restart failure determination threshold value although the complete combustion of the engine is not determined, interrupting a restart operation of the engine, and restarting the restart operation of the engine after elapse of a predetermined period of time.

2. An engine controller according to claim 1, wherein the start failure determination crank-angle change amount determination value setting section sets the restart failure determination threshold value to a value smaller than that in a case where the amount of increase in the engine rpm is larger than a predetermined increase amount when the amount of increase in the engine rpm is smaller than the predetermined increase amount.

3. An engine controller according to claim 1, further comprising a battery-voltage sensor for detecting a battery voltage, wherein the start failure determination crank-angle change amount determination value setting section corrects the restart failure determination threshold value based on a battery voltage at restart of the engine.

4. An engine controller according to claim 1, further comprising an intake-pipe pressure sensor for detecting an intake-pipe pressure of the engine, wherein the start failure determination crank-angle change amount determination value setting section corrects the restart failure determination threshold value based on the intake-pipe pressure at restart of the engine.

5. An engine control method for automatically stopping an engine when an engine automatic-stop condition is satisfied and for restarting the engine when a restart condition is subsequently satisfied, comprising:

a crank-angle detection step of detecting a crank angle of a crankshaft of the engine;

an engine-rpm computation step of computing an engine rpm based on the crank angle;

a crank-angle change amount computation step of computing a crank-angle change amount based on the crank angle;

an engine complete-combustion determination step of determining a complete combustion of the engine when the engine rpm becomes higher than a preset predetermined rpm after the restart condition is satisfied;

an engine-rpm increase amount computation step of computing an amount of increase in the engine rpm, generated by first ignition of the engine after the restart condition is satisfied;

a start failure determination crank-angle change amount determination value setting step of setting a restart failure determination. threshold value based on the amount of increase in the engine rpm; and a restart failure determination step of determining a restart failure when the crank-angle change amount from a first ignition timing of the engine after the restart condition is satisfied becomes larger than the restart failure determination threshold value although the complete combustion of the engine is not determined, interrupting a restart operation of the engine, and restarting the restart operation of the engine after elapse of a predetermined period of time.

* * * * *